United States Patent [19]

Shier et al.

[11] 4,335,874

[45] Jun. 22, 1982

[54] SHEET COUNTING APPARATUS

[75] Inventors: Ron Shier, Ryde; Roger F. E. Doyle, Havant, both of England

[73] Assignee: De La Rue Systems Limited, London, England

[21] Appl. No.: 100,459

[22] Filed: Dec. 5, 1979

[30] Foreign Application Priority Data

Dec. 8, 1978 [GB] United Kingdom ..... 47671/78

[51] Int. Cl.[3] ..... B65H 3/12

[52] U.S. Cl. ..... 271/95; 235/98 C

[58] Field of Search ..... 235/92 SB, 99 R, 98 R–98 C; 271/4, 94, 95, 96, 98, 105, 108, 110, 118, 144, 226, 261; 74/812

[56] References Cited

U.S. PATENT DOCUMENTS

| | | | |
|---|---|---|---|
| 3,207,005 | 9/1965 | Geyer | 74/812 |
| 3,904,189 | 9/1975 | Murakami | 271/95 |
| 3,944,210 | 3/1976 | McInerny | 271/118 |
| 3,953,022 | 4/1976 | Oshima | 271/110 |
| 3,981,208 | 9/1976 | Moses | 74/812 |
| 4,135,709 | 1/1979 | Uchida et al. | 271/95 |

FOREIGN PATENT DOCUMENTS

| | | |
|---|---|---|
| 769065 | 2/1957 | United Kingdom . |
| 787624 | 12/1957 | United Kingdom . |

*Primary Examiner*—L. T. Hix
*Assistant Examiner*—Benjamin R. Fuller
*Attorney, Agent, or Firm*—Frost & Jacobs

[57] ABSTRACT

The invention relates to apparatus for counting flexible sheets contained in a stack, such as a pile of banknotes.

The apparatus is of the type which has a rotary sheet removing assembly including a number of suction organs to which vacuum is applied in sequence and which contact the side face of a free end of a stack of notes to deflect each note from its initial position and count it.

Normally after the machine has stopped and is to be restarted the rotary assembly is moved backwards until one of the suction organs is in the appropriate place to move the next sheet. This presents problems when handling soft or warm sheets.

The invention involves rotating the rotary sheet removing assembly slowly in a forward, i.e. running direction, prior to the commencement of the sheet counting operation until each organ is effectively positioned in line with the face of a stack.

In the drawing (FIG. 1) the rotary sheet removing assembly (2) is driven by an electric motor (M) through a gear box (GB) driving through a pulley (8) and driving band (6). The special gear box (GB) is so designed that when the motor (30) rotates in one direction it drives the pulley wheel (8) at one speed and when the motor is reversed it drives the pulley wheel (8) in the same direction but at a slower speed.

9 Claims, 4 Drawing Figures

SHEET COUNTING APPARATUS

This invention relates to apparatus for counting flexible sheets contained in a stack, for example, a pile of banknotes. More specifically, said apparatus is of the type (hereinafter referred to as "the type described") comprising a means for clamping one end of a stack of sheets and a rotary sheet-removing assembly including a plurality of suction organs which are adapted to contact a side face of the free end of the stack and to deflect each sheet from its initial position and to count it, the deflecting and counting being accomplished through the sequential application of vacuum to each of the organs as the assembly rotates.

BACKGROUND OF THE INVENTION

A basic example of such apparatus is disclosed in U.K. Pat. No. 769065. A more narrowly defined example of a sheet counting apparatus of this type is described in the U.K. Pat. No. 787624. The counting means in this disclosure is actuated upon rotation of the rotary assembly regardless as to whether or not the operative suction organ is bearing a sheet, and accordingly, means are provided to inhibit counting and rotation of said assembly if a predetermined degree of suction is not attain in the apparatus. In such an arrangement, the apparatus could fail to start if a suction organ was not correctly positioned against the face of the stack because the resulting air leakage would prevent the requisite suction being attained. Accordingly, the disclosure describes a method of ensuring that a suction organ is correctly positioned prior to operation of the apparatus and which is effected by reversing momentarily the rotary assembly until it is arrested by a stop means at an appropriate angular position.

The versatility of apparatus of the type described may be usefully extended by the provision of a "batching" facility, viz to enable the apparatus to deflect only a predetermined quantity of sheets, which is thereafter removed as a batch. However, while handling soft or worn sheets, we have found that difficulties may arise during reverse rotation of the apparatus because of the physical layout and geometry of the suction organs and the rotary assembly, and accordingly it is the object of the present invention to overcome the problem.

SUMMARY OF THE INVENTION

According to the present invention sheet counting apparatus of the type described is characterized in that an indexing means is provided to rotate the rotary sheet removing assembly in a forward (viz normal running) direction prior to the commencement of a sheet counting operation until a suction organ is effectively positioned in alignment with the face of the stack.

Preferably the indexing means comprises means to determine the position of each of the suction organs with respect to a fixedly mounted detector means to arrest rotation of said rotary assembly upon the attainment of any one of said positions. In a convenient arrangement the rotary assembly is provided with a plurality of marker devices, each one being associated with the angular position of a suction organ and capable of being detected by the detector means, which preferably comprises a photo-electric device.

Preferably the indexing means serves to rotate the rotary assembly at a speed slower than its normal running speed. The relative reduction ratio is not critical and may be between 5 and 20 to 1, but we have found that a reduction of approximately 12 to 1 to be particularly suitable.

The rotary assembly may be driven by any suitable means during indexing. For example, a selectively engageable geared auxiliary motor of known type may be provided, or more preferably, the motor adapted to drive the rotary assembly during normal running, may also be employed for indexing. Such a latter motor may include a known dualpurpose gearbox having two selectively engageable gear trains. However, in the preferred embodiment of the invention we employ a gear box having two independent gear trains terminating at a common output shaft, and each provided with an overrunning clutch in conjunction with a reversible driving motor. More explicitly, the said gear trains are provided with an odd and even number of gear axle-shafts, respectively, and thus when the motor is running in one direction one gear train is effective and the clutch of the other over-rides. When the motor is running in the other direction the converse applies, but in both cases the common output shaft is driven in the same direction, the relative speeds in the two cases, of course, being dependent upon the specific gear ratios of the respective gear trains.

Preferably a brake means is provided to positively arrest the mechanism after indexing has been completed. The said brake means may be applied to any suitable rotary component but we prefer to use an electromagnetically controlled friction brake on the armature shaft of the driving motor.

THE PREFERRED EMBODIMENT

The general construction of a sheet counting machine "of the type described" is fully described in the abovementioned prior art disclosures.

Figure 1:
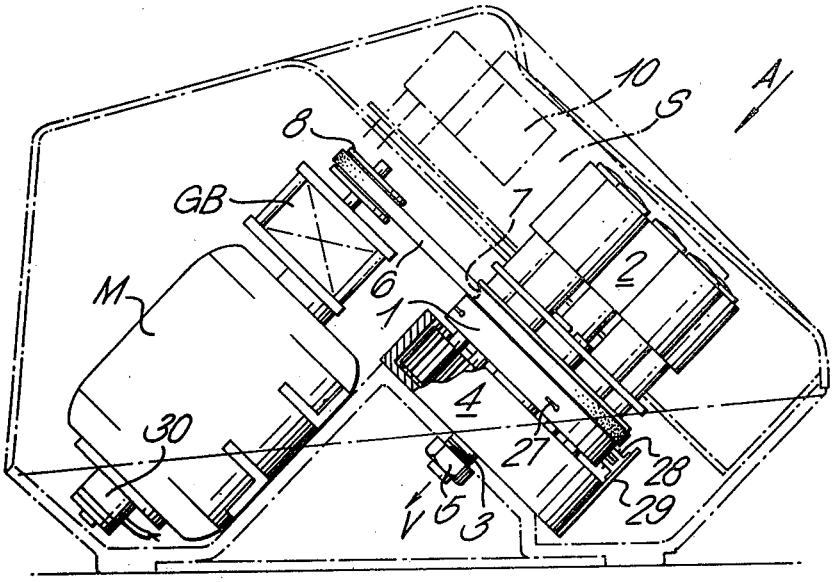
FIG. 1 is a schematic vertical elevation showing the major components of a banknote counting machine.
Figure 2:
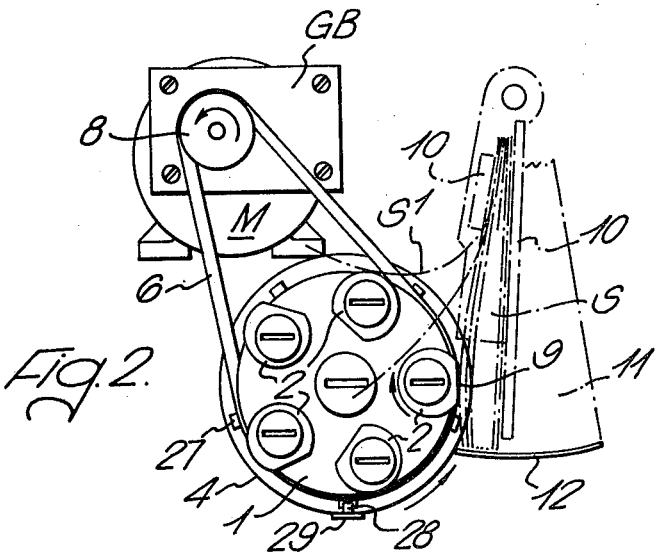
FIG. 2 is a schematic view of FIG. 1 as viewed in the direction of the arrow A.

The machine shown in FIG. 1 essentially includes a stationary stub-shaft 3, having an axial bore in communication with a source of vacuum V, upon which is rotationally disposed a disc member 1, which in turn, serves to mount five rotary suction organs 2. The lower end of the stub-shaft 3 passes through an internally toothed stationary gear-ring member 4 and is secured to the framework of the apparatus by a retaining nut 5. The lower ends of the suction organs depend below the disc member 1 and are each provided with a fixedly mounted gear pinion which meshes with the teeth of the gear ring member 4. The disc member is rotated in a counterclockwise direction by means of a 'V' belt 6, disposed in a groove 7 formed in the disc, and a driven pulley 8. It will thus be seen that rotation of the disc, via the respective gear members, causes the suction organs 2 to rotate in a clockwise direction about their respective axes (see the arrows in FIG. 2).

Each suction organ is provided with a sheet-engaging face 9 which includes a suction port (not shown) which serves to grip a sheet presented thereto. Vacuum is applied sequentially to the port via the following route, (i) through an internal axial bore formed in the suction organ which terminates at an annular space formed around the organ at its journal surface within the disc, (ii) through a radial conduit formed in the disc connecting the annular space with an arcuate space formed in the wall of the stub-shaft, and (iii) through the axial bore of the stub-shaft, referred to above. The said arcuate space thereby serves as a stationary air commutator and which effectively admits vacuum to the suction ports immediately before the sheet-engaging face 9 is presented to the stack of sheets (indicated by symbols 5), and thereafter cuts off the vacuum after the rotary assembly has rotated through a predetermined angle of rotation. In operation, during rotation of the assembly, the suction organs act on the stack in turn and the free ends of the sheets (the other ends of which are clamped by a clamping means 10) are conveyed sequentially across the rotary assembly to a position $S^1$, and counted.

The sheet clamping means include a support 11 to support the major side edge of the stack and an arcuate plate 12, disposed normally to the plate 11, to locate the minor edge of the stack. In the present embodiment of the invention the axis of the rotary assembly is inclined at an angle towards the operator and accordingly upon opening the clamping means, a bundle of banknotes introduced therein will be aligned automatically by gravitational means in two directions against the plates 11 and 12.

Figure 3:
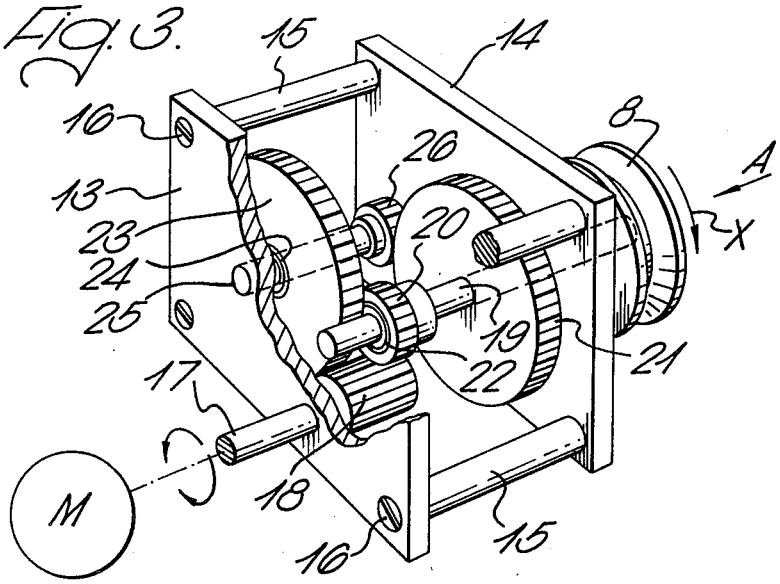
FIG. 3 is a partly cut-away perspective view of the part of the mechanism indicated by symbol GB in FIGS. 1 and 2.

The method of driving the rotary assembly from a reversible electric motor M will now be described with additional reference to FIG. 3.

Attached to the output end of the motor M there is provided a gear box GB comprising a pair of frame plates 13 and 14 spacially connected together in parallel relationship by four pillars 15 and associates screws 16. Symbol 17 indicates the end of the motor armature shaft, which passes through the frame plate 13 and carries a gearbox input pinion 18. The output shaft of the gearbox is indicated at 19 and passes through both frame plates and terminates at the grooved pulley 8, referred to above. Disposed between the frame plates, the output shaft 19 is provided with a freely mounted gear-wheel 20 and a fixedly mounted gear-wheel 21. The center of the former gear-wheel is provided with a first one-way clutch 22 which serves to transmit power to the shaft 19 when the gear-wheel 20 is driven in an anti-clockwise direction. It should be noted that all directions of rotation are as viewed by the operator of the machine, i.e. in the direction of the arrow A. The gear-wheel 20 and the pinion 18 collectively provide a reduction ratio of 1.7:1 and thus during normal running of the apparatus the pulley 8 is driven in a counterclockwise direction (see arrow X) when the motor shaft 17 is rotating in a clockwise direction.

The input pinion 18 also meshes with a freely mounted gear-wheel 23 the hub portion of which contains a second oneway clutch 24 disposed on a gear-box lay-shaft 25. The latter clutch is arranged in an opposite sense to the clutch 22 and serves to transmit power to the shaft 25 only when the gear-wheel 23 is driven in a clockwise direction. Fixedly mounted to the lay-shaft 25 is a pinion 26 which meshes with the gear-wheel 21, referred to above. The compound gearing system thus described provides an overall reduction ratio of 20:1 and thus, during indexing, the pulley 8 is driven at slow speed in a counterclockwise direction when the motor is rotating in a counterclockwise direction.

It will thus be appreciated that a motor M having an operating speed of 1400 R.P.M. will drive the pulley 8 in a counterclockwise direction either at 823.5 or 70 R.P.M. according to the direction of the motor.

Figure 4:
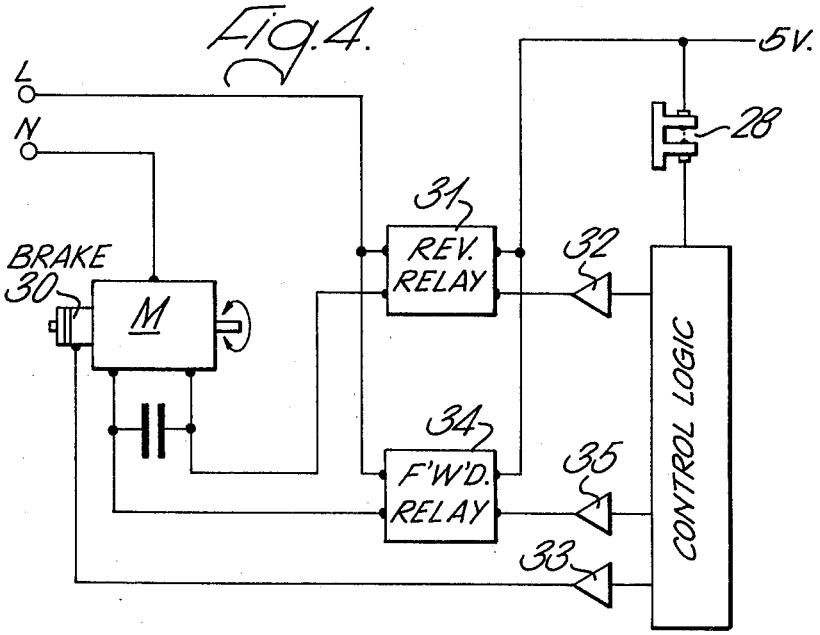
FIG. 4 is a block circuit diagram.

The means for indexing the rotary assembly, and the motor control means for bringing one of the suction organs to its correct starting position, will now be described with additional reference to the block circuit diagram in FIG. 4. It should be noted that the rectangle indicated CONTROL LOGIC is in effect a programmed microprocessor which serves to control the overall sequential operation of the apparatus including count-programming, starting, counting and stopping, and as such forms no part of the present invention per se. Accordingly, only the functions necessary for the understanding of the invention have been illustrated.

Mounted on the cylindrical surface of the disc member 1 are provided five markers, one of which is indicated by symbol 27. The markers, which are radially disposed in relation to the disc, are sited to correspond with respective suction organs, and in conjunction with an LED transmitter/sensor device 28 disposed upon a bracket member 29, serve to detect the five start positions of the rotary assembly. The arrangement is such that when a suction organ is correctly positioned so that the port face thereof abuts with the face of the stack, the corresponding marker obstructs the sensor and creates a signal in the circuit shown in FIG. 4.

The rear end of the armature shaft of the motor M is provided with an electro-magnetic brake 30, which upon energization, serves to arrest rotation of the motor.

Sheet counting is effected by a well known counting means (not illustrated) which is not critical to the invention. Such a means may comprise a count pulse generator adapted to produce a count plus for each 1/5 revolution of the disc member 1, and which, via a minimum vacuum level switch, serves to increment a counter unit.

OPERATION OF THE APPARATUS

Upon switching-on the apparatus, or after the completion of a batching operation, the rotary assembly will automatically HOME to one of the five incremental start positions in the manner next described. If the rotary assembly is positioned in an incorrect manner, i.e. positioned so that there is not a marker 27 in alignment with device 28, radiation from the LED will influence the sensor and the signal therefrom will actuate a REVERSE RELAY 31 via the CONTROL LOGIC and a driver AMPLIFIER 32. The RELAY 31 energizes the motor M so as to run in a counterclockwise direction and, via the gear members 18/23, the clutch 24, gear members 26/21, and the belt system 8/6/1, the rotary assembly is rotated at slow speed until one of the markers 27 is in alignment with the transmitter/sensor 28. Thereafter the motor is deenergized, and the brake 30 is momentarily energized, via a driver AMPLIFIER 33 to arrest further rotation of the motor. The rotary assembly is thereby correctly indexed and upon the creation of a start signal the FORWARD relay 34, via the CONTROL LOGIC and a drive AMPLIFIER 35, rotates the motor in a clockwise direction thereby to drive the rotary assembly at normal running speed to effect counting, via the clutch 22, the gears 18/20 and the belt system referred to above.

What is claimed is:

1. Apparatus for counting flexible sheets contained in a stack, the apparatus comprising means for clamping one end of a stack of sheets; a rotary sheet removing assembly including a plurality of suction organs which are arranged, on rotation, sequentially to contact the side face of the free end of the stack and to remove the sheets from their initial position in the stack; counting means to count each sheet removed; drive means to rotate said sheet removing assembly in a forward direction, said drive means comprising a driving motor adapted to drive said rotary assembly via a gear box having two selectively engageable gear trains, one providing a normal running speed for counting and the other providing a lower running speed for indexing prior to a counting operation, and indexing means to energize said drive means to rotate said rotary assembly, prior to a counting operation, to a start position in which a suction organ is effectively positioned in alignment with the side face of the stack.

2. Apparatus as claimed in claim 1 in which the indexing means comprises a marker device attached to the rotary assembly to correspond with each suction organ, and a fixedly mounted detector means to sense the presence of a marker device, said detector means being positioned to arrest rotation of said rotary assembly with a suction organ effectively aligned with said face of the stack prior to the commencement of a counting operation.

3. Apparatus according to claim 1 and in which the detector device comprises a photo-electric device.

4. Apparatus as claimed in claim 3 in which said detector means comprises a spatially disposed radiation source and photoelectric sensor, said marker being adapted to pass therebetween.

5. Apparatus according to claim 1 and in which the indexing means serves to rotate the rotary assembly at a speed slower than its normal-running speed.

6. Apparatus according to claim 5 and in which the ratio of the slower speed to the normal speed is between 5 and 20 to 1.

7. Apparatus according to claim 6 and in which the ratio is 12 to 1.

8. Apparatus according to claim 1 in which the gearbox has two independent gear trains terminating at a common output shaft, and each provided with an overrunning clutch in conjunction with a reversible driving motor.

9. Apparatus according to claim 8 in which said gear trains are provided with an odd and even number of gear axle-shafts, respectively, and thus when the motor is running in one direction one gear train is effective and the clutch of the other over-rides, and when the motor is running in the other direction the converse applies, but in both cases the common output shaft is driven in the same direction, the relative speeds in the two cases, being dependent upon the specific gear ratios of the respective gear trains.

* * * * *